US009132323B2

(12) United States Patent
Beach et al.

(10) Patent No.: US 9,132,323 B2
(45) Date of Patent: Sep. 15, 2015

(54) ADJUSTABLE GOLF CLUB

(71) Applicant: Taylor Made Golf Company, Inc., Carlsbad, CA (US)

(72) Inventors: Todd P. Beach, Encinitas, CA (US); Bret H. Wahl, Escondido, CA (US); Scott Taylor, Bonita, CA (US); Peter L. Larsen, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 251 days.

(21) Appl. No.: 13/789,484

(22) Filed: Mar. 7, 2013

(65) Prior Publication Data

US 2014/0256461 A1 Sep. 11, 2014

(51) Int. Cl.

| | |
|---|---|
| ***A63B 69/36*** | (2006.01) |
| ***A63B 53/02*** | (2015.01) |
| *A63B 53/04* | (2015.01) |

(52) U.S. Cl.

CPC ..... *A63B 53/02* (2013.01); *A63B 53/047* (2013.01); *A63B 2053/025* (2013.01)

(58) Field of Classification Search

CPC . A63B 53/02; A63B 53/047; A63B 2053/025
USPC ..... 473/244–248, 305–315
See application file for complete search history.

(56) References Cited

U.S. PATENT DOCUMENTS

| | | | | | |
|---|---|---|---|---|---|
| 1,026,181 | A * | 5/1912 | Seely | 473/315 |
| 1,983,158 | A * | 12/1934 | Young | 473/310 |
| 3,191,936 | A * | 6/1965 | Guier | 473/313 |
| 3,909,005 | A * | 9/1975 | Piszel | 473/248 |
| 4,655,457 | A * | 4/1987 | Thompson | 473/239 |
| 5,244,205 | A * | 9/1993 | Melanson et al. | 473/248 |
| 5,513,844 | A * | 5/1996 | Ashcraft et al. | 473/288 |
| 5,626,528 | A * | 5/1997 | Toulon | 473/248 |
| 5,839,973 | A * | 11/1998 | Jackson | 473/305 |
| 6,186,903 | B1 * | 2/2001 | Beebe et al. | 473/248 |
| 6,287,215 | B1 * | 9/2001 | Fisher | 473/309 |
| 6,368,230 | B1 * | 4/2002 | Helmstetter et al. | 473/244 |
| 6,431,993 | B1 * | 8/2002 | Dyer | 473/246 |
| 8,684,859 | B1 * | 4/2014 | Aguinaldo et al. | 473/307 |
| 8,715,102 | B1 * | 5/2014 | Aguinaldo et al. | 473/307 |
| 2011/0319185 | A1 * | 12/2011 | Beach et al. | 473/288 |

FOREIGN PATENT DOCUMENTS

| | | |
|---|---|---|
| JP | 2004-351173 | 12/2004 |

* cited by examiner

*Primary Examiner* — Sebastiano Passaniti
(74) *Attorney, Agent, or Firm* — Klarquist Sparkman, LLP

(57) ABSTRACT

Disclosed herein are embodiments of adjustable golf clubs comprising features which allow for the adjustment of a lie angle, a loft angle, or both a lie angle and a loft angle of the golf club. In some embodiments, a golf club head includes a body and a hosel, the hosel including an adjustment screw which can be tightened or loosened to adjust the lie and/or loft angles of a golf club head. In some embodiments, certain angles of a golf club head's geometry can be continuously adjustable through a predetermined range of angles.

13 Claims, 9 Drawing Sheets

ADJUSTABLE GOLF CLUB

FIELD

This disclosure concerns adjustable golf club heads and related methods.

BACKGROUND

Golf clubs are typically manufactured with standard lie and loft angles. Some golfers prefer to modify the lie and loft angles of their golf clubs in order to improve the performance and consistency of their golf clubs and thereby improve their own performance.

In some cases, golf club heads, particularly iron-type golf club heads, can be adjusted by being plastically bent in a post-manufacturing process. In such a bending process, it can be difficult to plastically bend the material of the club head in a desired manner without adversely affecting the shape or integrity of the hosel bore, the striking face, or other parts of the club head. In addition, advancements in materials and manufacturing processes, such as extreme heat treatments, have resulted in club heads that are stronger and harder to bend and have more sensitive surface finishes. This increases the difficulty in accurately bending a club head in a desired manner without adversely affecting the club head.

In other cases, golf club heads, particularly wood-type golf clubs (sometimes referred to as "metalwoods"), can be manufactured with an adjustable shaft attachment system which can allow adjustment of certain angles (i.e., the lie angle or the loft angle) of the golf club head. These systems can in some cases restrict the adjustability of the golf club head to a predetermined number of predetermined angles. That is, in some cases they do not allow continuous adjustment of the angles through a given range.

SUMMARY

Disclosed herein are embodiments of golf club heads that comprise features allowing continuous adjustment of the geometry of the golf club head and related methods. In some embodiments, a golf club head includes a hosel having a notch formed therein and a screw extending into the hosel and through the notch such that adjustment of the screw causes the hosel to bend at the notch. The hosel of an adjustable golf club head can include a shaft bore configured to receive a golf club shaft and an adjustment bore, wherein the screw extends from the adjustment bore, through the notch, and at least proximate to the shaft bore. In some embodiments, the shaft bore has a central longitudinal axis, the adjustment bore has a central longitudinal axis, and adjustment of the screw causes the central longitudinal axis of the shaft bore to rotate with respect to the central longitudinal axis of the adjustment bore.

In some embodiments, an adjustable golf club head can also include a body portion coupled to and extending away from the hosel, wherein adjustment of the screw causes the hosel to rotate with respect to the body portion, thereby changing either a lie angle or a loft angle of the golf club head. In some embodiments, an adjustable golf club head can include a solid piece of material situated within the shaft bore which separates a portion of the shaft bore which can receive the screw and a portion of the shaft bore which can receive a golf club shaft.

Adjustable golf club heads can also include a threaded boss element coupled to the hosel at a distal end portion of the shaft bore, a range limiter coupled to the hosel which mechanically limits tightening of the screw, and/or indicators which indicate a level to which the screw is tightened. In some embodiments, the notch extends past a centerline of the hosel. In some embodiments, the hosel of an adjustable golf club head includes an adjustment bore within which a head of the screw is positioned and an opening connecting the adjustment bore to the notch and the screw extends from the adjustment bore, through the opening, through the notch, and threads into an upper portion of the hosel.

In some embodiments, an adjustable golf club head includes a bearing pad situated between the head of the screw and the opening and/or a retaining ring situated within the adjustment bore. The bearing pad and/or retaining ring can include at least one spherical surface which can mate with the head of the screw. The bearing pad and/or retaining ring can include at least one cylindrical surface which can mate with the head of the screw.

In some embodiments, an adjustable golf club head includes a main body, a screw having threads, and a hosel having a shaft bore for receiving a golf club shaft, an adjustment bore for receiving the screw, a notch, an unthreaded opening connecting the notch to the adjustment bore, and a threaded opening connecting the notch to the shaft bore. The threaded opening can have threads complementing the threads of the screw, and the screw can extend from the adjustment bore, through the first opening, through the notch, through the second opening, and into the shaft bore.

Exemplary methods of adjusting the lie angle of a player's golf club include determining that a player's swing may benefit from an adjustment of the lie angle of one or more clubs in a set of golf clubs, each club having a club face and a shaft-receiving hosel, determining the amount of adjustment of the lie angle for the golf club, adjusting the golf club by turning a screw to cause the hosel to move toward or away from the club face, and ending the adjustment once the desired lie angle is obtained. In some methods, the adjustment is ended once a visual indicator reveals that the desired lie angle has been achieved.

In some embodiments, a golf club head comprises a hosel having a living hinge formed therein and a secondary member which increases a rigidity of the golf club head in the region of the living hinge. The secondary member can be an actuator which can cause adjustment of the golf club head at the living hinge, and the secondary member can be a screw.

The foregoing and other objects, features, and advantages of the invention will become more apparent from the following detailed description, which proceeds with reference to the accompanying figures.

DETAILED DESCRIPTION

Figure 1:
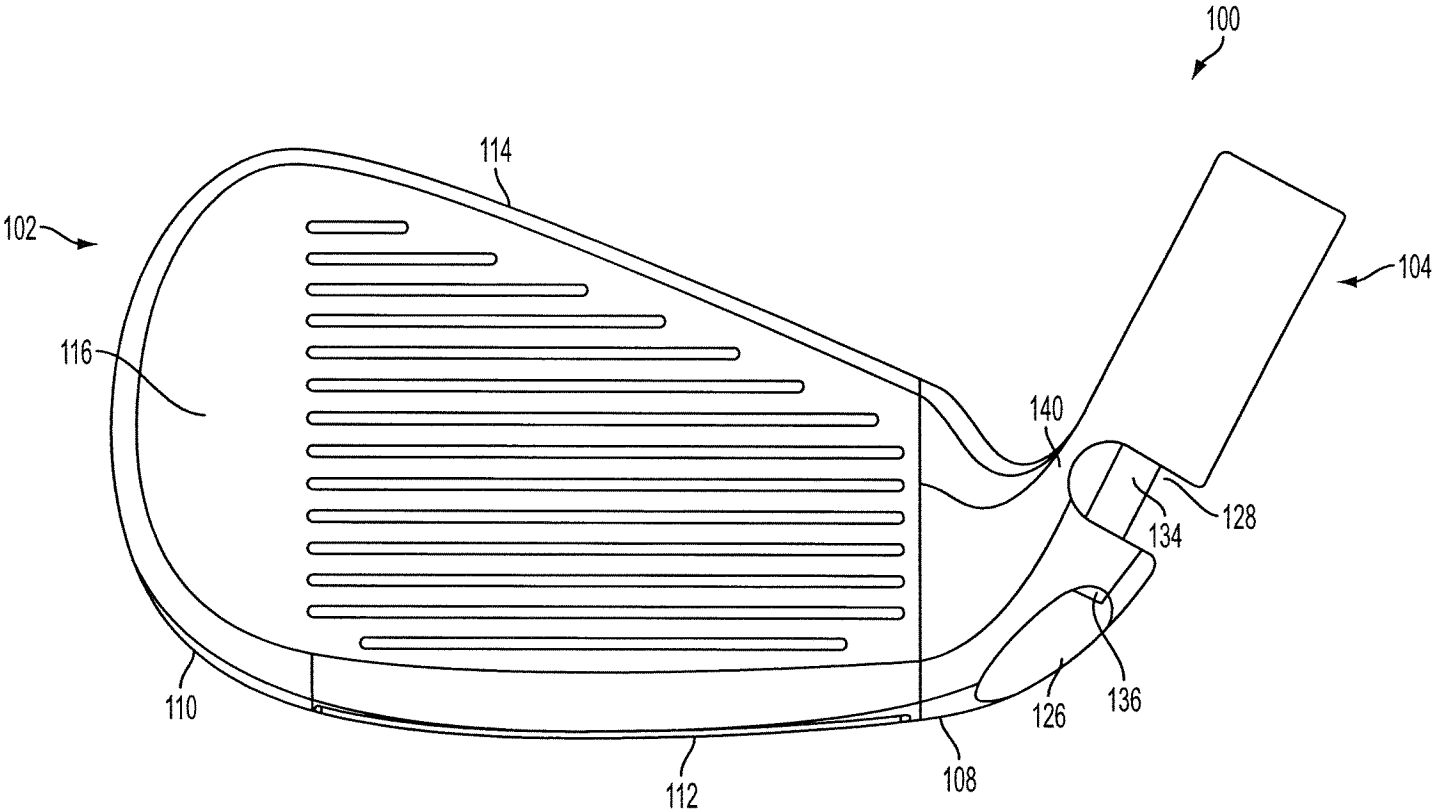
FIG. 1 shows an exemplary embodiment of an adjustable golf club head.
Figure 2:
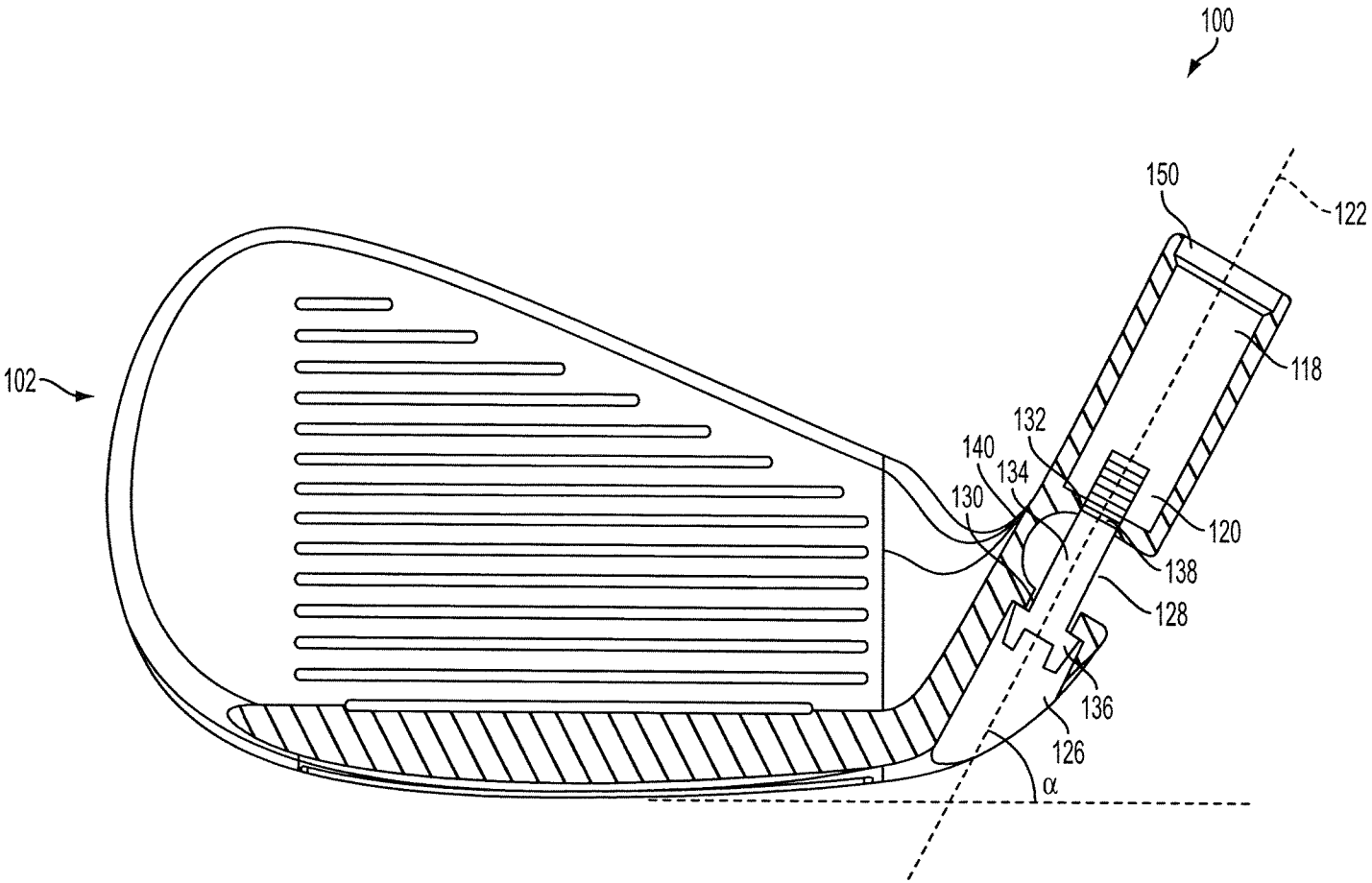
FIG. 2 shows a cross sectional view of the adjustable golf club head of FIG. 1.
Figure 3:
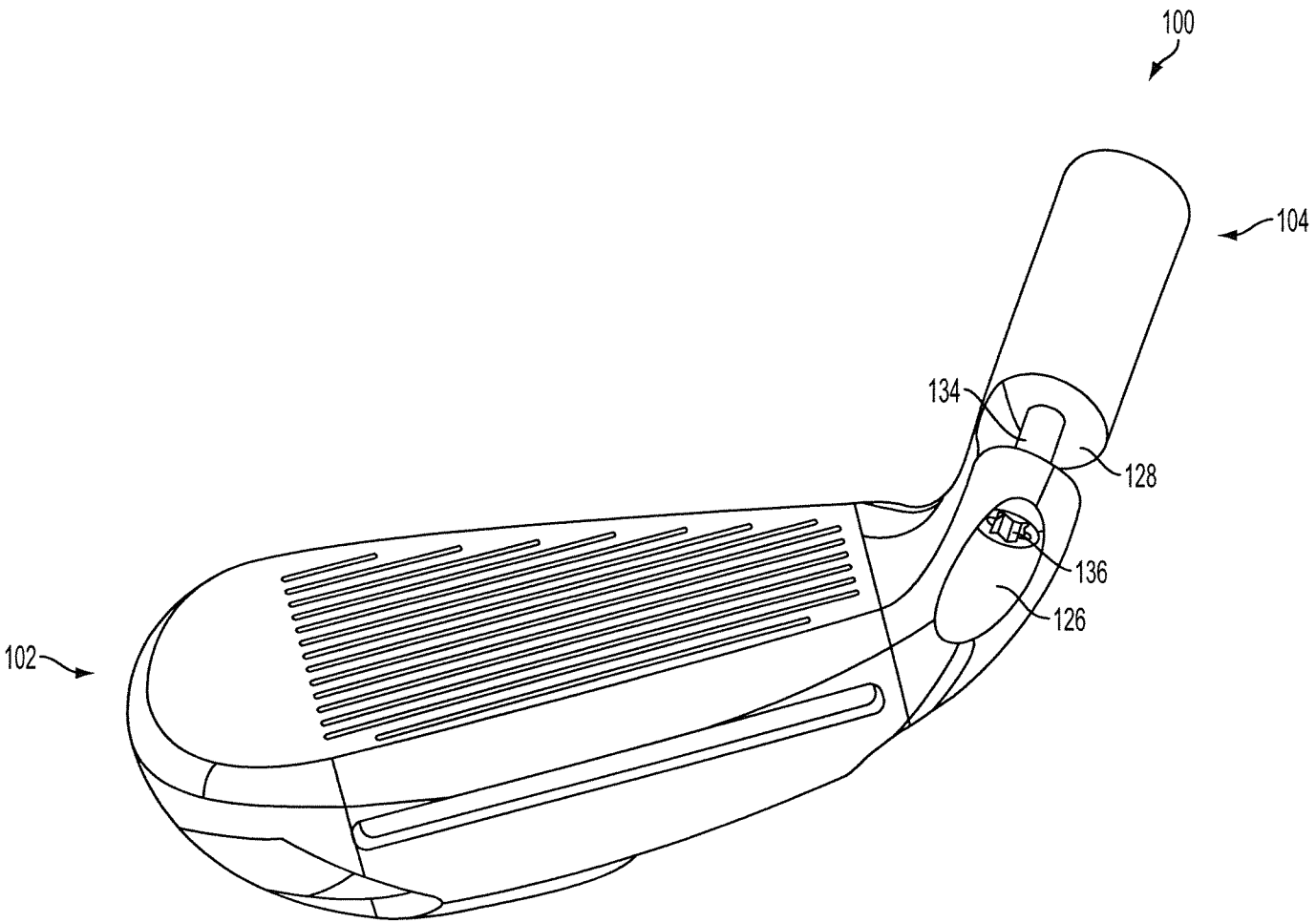
FIG. 3 shows a perspective view of the adjustable golf club head of FIG. 1.

A golf club generally comprises a golf club head and a golf club shaft. FIGS. 1-3 show an exemplary golf club head 100 which includes a body 102 and a hosel 104 configured to allow the club head 100 to be coupled to a shaft (not pictured). The golf club head 100 can include a heel portion 108, a toe portion 110, a sole portion 112, a topline portion 114, and a striking face portion 116 configured for striking golf balls.

The hosel 104 can include a shaft bore 118 formed within the hosel 104 that extends to a distal end portion 120 of the shaft bore 118. The shaft bore 118 can have a generally cylindrical shape, and can have a central longitudinal axis 122. The shaft bore 118 can be configured to receive a distal end portion of the shaft, which can be secured in the shaft bore 118 in various manners, such as with epoxy adhesive or glue. The hosel 104 can also include a recess 150, which can facilitate the securing of the shaft to the hosel 104, for example, by allowing the use of a sealing ring (not pictured) in the recess 150. In such a configuration, a central longitudinal axis of the shaft can be aligned with the central longitudinal axis 122.

For purposes of this description, the "hosel" of a golf club head includes the portion of the club head which encloses the shaft bore and extends to within the region of the heel portion of the body. Thus, the hosel of the golf club heads described herein includes the adjustment bore, notch, openings, and other components described more fully below. Thus, the hosel of the golf club heads described herein includes what is sometimes referred to in the industry as a "hosel blend." For purposes of this description, an "upper portion of the hosel" refers to the portion of the hosel which encloses the shaft bore.

The geometry of the golf club head 100 can be adjusted and thus a golf club can be tailored to an individual golfer. That is, the geometry of the body 102 and hosel 104 of the golf club head 100 can be adjusted based on a golfer's anatomy and/or golfing technique, in order to improve the reliability and/or quality of the golfer's shot. Generally, the geometry of the golf club head 100 can be adjusted to help ensure that when a golfer swings a golf club, the striking face portion 116 of the club head 100 strikes a golf ball in a consistent and desired manner (e.g., in a way that minimizes "slice" and/or "hook," as those terms are generally understood in the game of golf).

Figure 4:
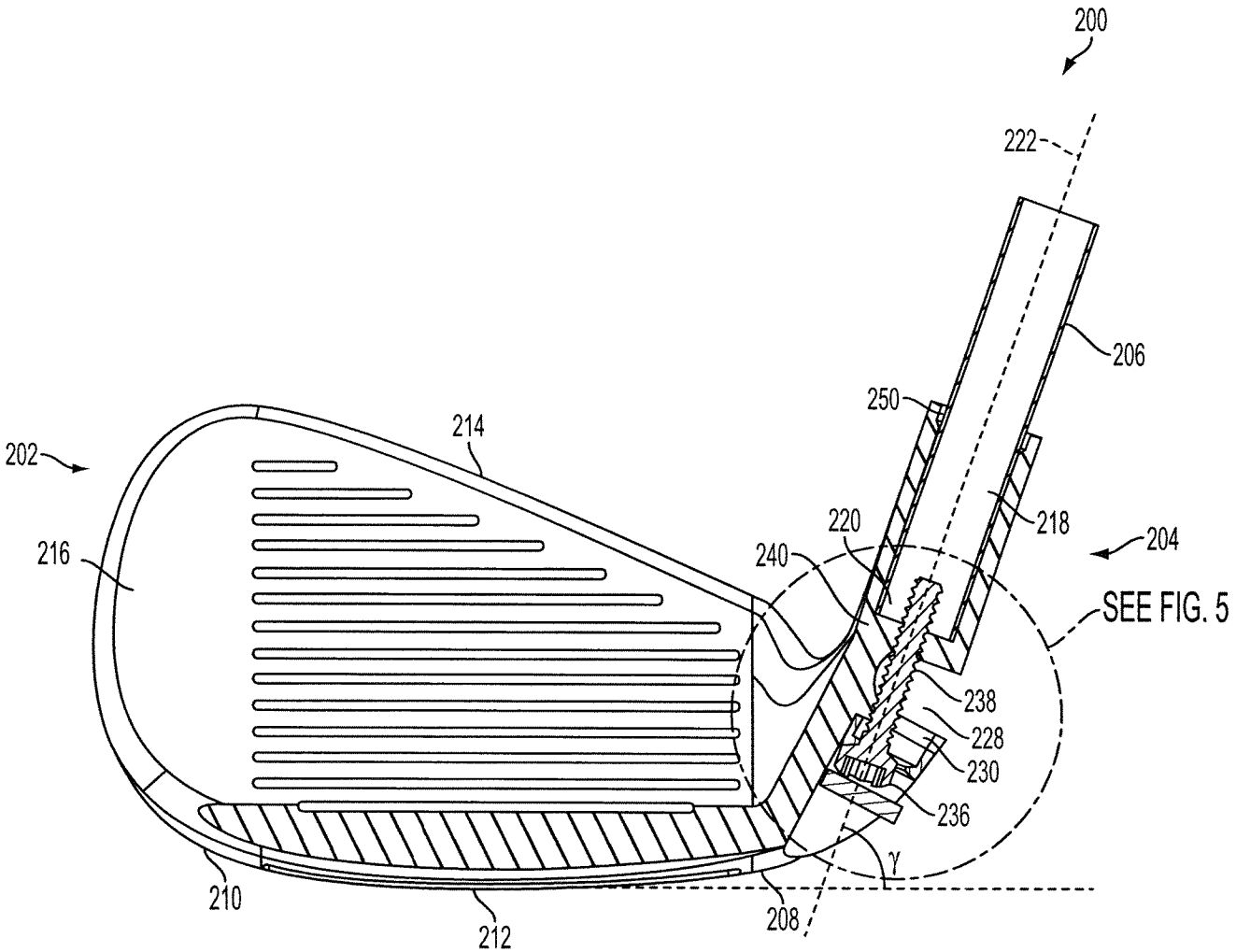
FIG. 4 shows a cross sectional view of an alternative exemplary embodiment of an adjustable golf club.

The terms "lie angle" and "loft angle" have well-understood meanings within the game of golf and the golf club industry. As used herein, these terms are intended to carry this conventional meaning. For purposes of illustration, the term "lie angle" can refer to an angle formed between the central longitudinal axis 122 of the shaft bore 118 and the ground when the sole portion 112 of the golf club head 100 rests on flat ground. For example, lie angle $\alpha$ is shown in FIG. 2 and lie angle $\gamma$ is shown in FIG. 4. Also for purposes of illustration, the term "loft angle" can refer to the angle formed between a line normal to the surface of the striking face portion 116 and the ground when the sole portion 112 of the golf club head 100 rests on flat ground. Thus, the loft and lie angles are geometrically independent of one another, and thus in various golf clubs can be adjusted either independently or in combination with one another. As one particular example, the loft and lie angles of club head 100 can each be independently adjusted by appropriately deforming the hosel 104.

FIGS. 1-3 show that a golf club head 100 can include an adjustment bore 126 and an adjustment notch 128 in the hosel 104. The adjustment bore 126 can be generally cylindrically shaped, and can open in a direction opposite that of the shaft bore 118. As discussed further below, a central longitudinal axis of the adjustment bore can be generally aligned with the axis 122 of the shaft bore 118, but can be displaced from such alignment as the geometry of the golf club head 100 is adjusted. As shown, the bores 118, 126 can have differing diameters, but in alternative embodiments, each of the bores can have any of various appropriate diameters and in some embodiments can have the same diameter. As shown, the hosel 104 can have a narrow portion, or living hinge 140, in the region of the hosel 104 opposing the notch 128. The living hinge 140 can be formed as a continuous piece of material, formed integrally with the remainder of the hosel 104, and can be configured to provide a relatively flexible location about which the club head 100 can be bent.

A first opening 130 can be provided in the hosel 104 which can connect a distal end portion of the adjustment bore 126 and the notch 128. A second opening 132 can be provided in the hosel 104 which can connect a distal end portion of the shaft bore 118 with the notch 128. As shown, the openings 130 and 132 can have diameters which are smaller than the diameters of the adjustment bore 126 and the shaft bore 118. In some embodiments, the openings 130 and 132 can be generally aligned with one another, and can have central longitudinal axes which are generally aligned with the central longitudinal axis 122 of the shaft bore 118. The opening 132 can be provided with mechanical threads extending radially inward into the opening 132.

FIGS. 1-3 show an adjustment screw 134 having a head portion 136 and a threaded portion 138 having threads complementing those of the second opening 132. As shown, the head 136 of the screw 134 can be situated in the adjustment bore 126, and the threaded portion 138 can extend from the head 136, through the first opening 130 and notch 128, be threaded through the second opening 132, and extend into the shaft bore 118. As shown, the first opening 130 can have a diameter which is smaller than a diameter of the screw head 136 but larger than a diameter of the threaded portion 138. Thus, the threaded portion 138 can move freely through the opening 130, but the screw head 136 cannot.

In this configuration, the screw 134 can be used as an actuator which can cause adjustment of the golf club head at the hinge to control geometric properties of the golf club head 100. Specifically, in the illustrated embodiment, the screw 134 can be used to modify the lie angle of the golf club head 100. When the screw 134 is tightened (e.g., threaded through the threads in the second opening 132 toward the shaft bore 118), the hosel 104 bends at the living hinge 140 such that the body 102 of the club head 100 rotates away from the hosel 104 about the hinge 140. Thus, when the screw 134 is tightened, the topline portion 114 and toe 110 of the head 100 rotate away from the hosel 104 and the lie angle $\alpha$ decreases.

A retaining ring (not pictured) can be provided within the adjustment bore 126 such that when the screw 134 is loosened (e.g., threaded through the threads in the second opening 132 away from the shaft bore 118), the hosel 104 bends at the living hinge 140 such that the body 102 of the club head 100 rotates toward the hosel 104 about the hinge 140. Thus, when the screw 134 is loosened, the topline portion 114 and toe 110 of the head 102 rotate toward the hosel 104 and the lie angle $\alpha$ increases. These features are described in more detail below.

A golf club can be fabricated, sold, and/or delivered with the golf club head 100 in a neutral configuration. That is, the configuration in which it is anticipated that the fewest golfers will need to adjust the lie angle, or in which it is anticipated that the average amount by which golfers need to adjust the lie angle is minimized. This neutral configuration can be determined, for example, based on expert knowledge or empirical studies. The golf club head 100 can be fabricated such that this neutral configuration is achieved by positioning the screw 134 within the adjustment bore 126 and tightening it to a predetermined degree, which can include not tightening it at all. When an individual golfer commences the process of adjusting, or "tuning," the golf club, the screw can be further tightened to decrease the lie angle, or the screw can be loosened to increase the lie angle.

By fabricating and/or selling the golf club head 100 in the neutral configuration, the number of golfers who adjust the club head 100 can be decreased, and the degree to which many golfers adjust the golf club head 100 can be reduced. This can help to reduce the stresses induced in the golf club head 100 and/or reduce the potential for developing problems of fatigue in the hinge 140. Further, a screw 134 which has been tightened to a predetermined degree can carry a net tension force, which can increase frictional forces between the screw 134 and the rest of the club head 100. Increased frictional forces can in turn help to ensure that the screw 134 is not unintentionally tightened, loosened, or removed from the openings 130 and 132, and the adjustment bore 126.

It can be desirable to design the hinge 140 to be relatively flexible so that it can be more easily bent by tightening or loosening the screw 134. This can be accomplished by reducing the cross sectional area of the hinge 140 or by forming the hinge 140 from a relatively flexible material. The hinge 140 can be made to be sufficiently flexible to allow adjustment while retaining sufficient strength to withstand stresses caused by using the club head 100 to hit a golf ball. For example, striking a golf ball with the striking face portion 116 of the club head 100 can induce torque in the hosel 104. Thus, the strength of the hinge 140, in combination with the screw 134 (which can provide additional strength) can be capable of resisting the torque experienced when the club head 100 is used to hit a golf ball. That is, the screw can act as a secondary member which increases the rigidity of the golf club head in the region of the hinge. Further, the hinge 140, in combination with the screw 134, can be capable of resisting the stresses caused by repetitive use of the club head 100 to strike golf balls, that is, they can be resistant to fatigue failure due to repetitive, cyclic stresses, for example, the stresses caused by hitting a golf ball several thousand times.

The features illustrated in FIGS. 1-3 allow the lie angle of the golf club head 100 to be adjusted more easily than the lie angle of many other known golf club heads. The lie angle of the golf club head 100 can be adjusted simply by tightening or loosening a single screw 134. For example, a golfer can adjust the lie angle $\alpha$ by hand or with a single hand tool (e.g., a screwdriver). This can allow repeatable, reversible, and/or rapid adjustment of the golf club head. This allows significant improvement over previous known methods in which a golf club head is plastically bent in a post manufacturing process. It also allows significant improvement over previously known systems which use an adjustable shaft attachment system, as these systems allow only incremental adjustment between predetermined, discrete angles, rather than continuous adjustment over a continuous range of angles, as in golf club head 100.

As best shown in FIGS. 1 and 2, the notch 128 can extend inward from the periphery of the hosel 104 opposite the club head body 102, through the hosel 104 toward the body 102, and stop short of the opposing periphery of the hosel 104, thus forming the hinge 140. Thus, the notch 128, the screw 134, and the hinge 140 can be aligned with each other so that tightening or loosening the screw 134 can cause a corresponding change primarily in the lie angle $\alpha$, without significantly changing the loft angle, of the club head 100.

In alternative embodiments, the alignment of the notch, screw, and hinge can be displaced angularly about the central longitudinal axis of the hosel bore from the alignment of the notch 128, screw 134, and hinge 140 shown in FIGS. 1-3. In one exemplary alternative embodiment, the alignment can be angularly displaced from that illustrated in FIGS. 1-3 by about ninety degrees. In this alternative embodiment, tightening or loosening the screw can cause a corresponding change primarily in the loft angle, without significantly changing the lie angle of the golf club head. In another exemplary alternative embodiment, the alignment can be angularly displaced from that shown in FIGS. 1-3 by more than zero but less than ninety degrees. In this alternative embodiment, tightening or loosening the screw can cause a significant corresponding change in both the lie angle and the loft angle.

Figure 5:
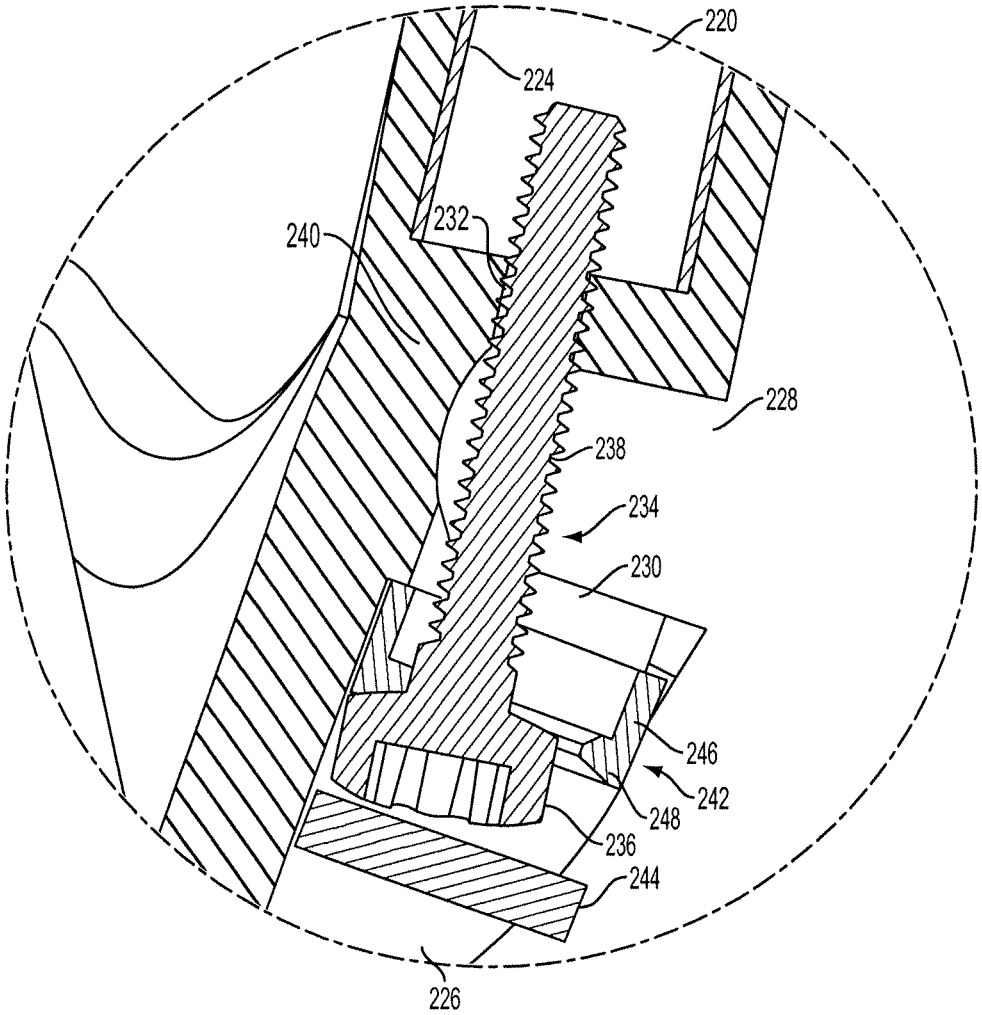
FIG. 5 shows an enlarged detailed partial cross sectional view of the adjustable golf club of FIG. 4.

FIGS. 4 and 5 show that an alternative golf club head 200 can include a body 202 and a hosel 204. The body 202 can include a heel portion 208, a toe portion 210, a sole portion 212, a topline portion 214, and a striking face portion 216. The hosel 204 can include a shaft bore 218 having a recess 250, a central longitudinal axis 222, and a distal end portion 220 which can receive and be secured to a distal end portion 224 (FIG. 5) of a shaft 206. The hosel 204 can also include an adjustment bore 226, an adjustment notch 228, a living hinge 240, a first opening 230 connecting a distal end of the adjustment bore 226 with the notch 228, and a second opening 232 connecting a distal end of the shaft bore 218 with the notch 228. An adjustment screw 234, having a head portion 236 and a threaded portion 238, can extend through the adjustment bore 226, first opening 230, notch 228, threaded opening 232, and into the shaft bore 218.

Golf club head 200 can also include a screw bearing pad 242. The bearing pad 242 can be configured to support the screw head 236 within the adjustment bore 226, separating the screw head 236 from the first opening 230. The bearing pad 242 can include a first hollow portion 246 formed integrally with a second hollow portion 248. The first hollow portion 246 can be configured to avoid interference with the screw 234 (that is, to allow the screw 234 to pass through it without contacting it), and can be positioned adjacent to the first opening 230. The second hollow portion 248 can be configured for mating with the screw head 236, in a way that facilitates some degree of lateral movement and/or rotation of the screw head 236 relative to the bearing pad 242, for example, as needed as the screw 234 is loosened or tightened.

Thus, as best shown in FIG. 5, an inside diameter of the second hollow portion 248 can be smaller than an inside diameter of the first hollow portion 246, smaller than a diameter of the screw head 236, and larger than a diameter of the threaded portion 238 of the screw 234. Thus, the screw 234 can extend through the bearing pad 242, with the screw head 236 resting on the second hollow portion 248. Tightening of the screw 234 can cause it to come into contact with the bearing pad 242, bearing against the second hollow portion 248.

Further tightening of the screw 234 through the threaded opening 232 can thus cause the screw 234 to pull the bearing pad 242 generally toward the threaded opening 232, thereby causing the golf club head 200 to bend at the living hinge 240. That is, tightening the screw 234 can cause the topline portion 214 and toe 210 of the head 200 to rotate away from the hosel 202, thereby decreasing the lie angle γ (FIG. 4) of the golf club head 200.

The bearing pad 242 can be formed integrally with the rest of the hosel 204, or can be formed separately and coupled to the hosel 204 after each has been independently formed. Thus, use of the bearing pad 242 can allow the surface on which the screw head 236 bears to be formed from a material different from that used to form the rest of the golf club head 200. Use of the bearing pad 242 can also allow the surface on which the screw head 236 bears to be replaced periodically without a golfer needing to replace the entire golf club head 200.

Golf club head 200 can also include a retaining ring 244. The retaining ring 244 can be positioned within the adjustment bore 226 and can serve to partially enclose the screw 234 within the bore 226. The retaining ring 244 can include an opening (not pictured) through which a golfer or other person can reach the screw head 236 and thereby tighten or loosen the screw 234. The retaining ring 244 can comprise an annular piece of material coupled to the hosel 204 within the bore 226. The retaining ring 244 can in some cases prevent the screw 234 from falling out of the adjustment bore 226, and can provide a bearing surface configured for mating with the screw head 236.

Loosening of the screw 234 can cause it to come into contact with and bear against the retaining ring 244. Further loosening of the screw 234 through the threaded opening 232 can thus cause the screw 234 to push the retaining ring 244 generally away from the threaded opening 232, thereby causing the golf club head 200 to bend at the living hinge 240. That is, loosening the screw 234 can cause the topline portion 214 and toe 210 of the head 200 to rotate toward the hosel 202, thereby increasing the lie angle γ of the golf club head 200.

The retaining ring 244 can be coupled to the hosel 204 by casting, welding, bonding or any other method known in the art. Use of the retaining ring 244 can allow the surface on which the screw head 236 bears to be formed from a material different from that used to form the rest of the golf club head 200. Use of the retaining ring 244 can also allow the surface on which the screw head 236 bears to be replaced periodically without a golfer needing to replace the entire golf club head 200.

FIGS. 4 and 5 show that the shaft 206 can be hollow, and can extend to the distal end portion 220 of the shaft bore 218 and be secured therein. Thus, as shown, the threaded portion 238 of the screw 234, which extends through the second opening 232 and into the distal end portion 220 of the shaft bore 218, can also extend into the distal end portion 224 of the hollow shaft 206. In some alternative embodiments, the shaft of a golf club need not extend all the way to the distal end portion of the shaft bore of the hosel. Thus, in some alternative embodiments, a solid piece of material can separate the shaft bore into two sections, with the screw extending into one section and the shaft extending into the other portion. In such an embodiment, the screw need not extend within the hollow shaft.

Figure 6:
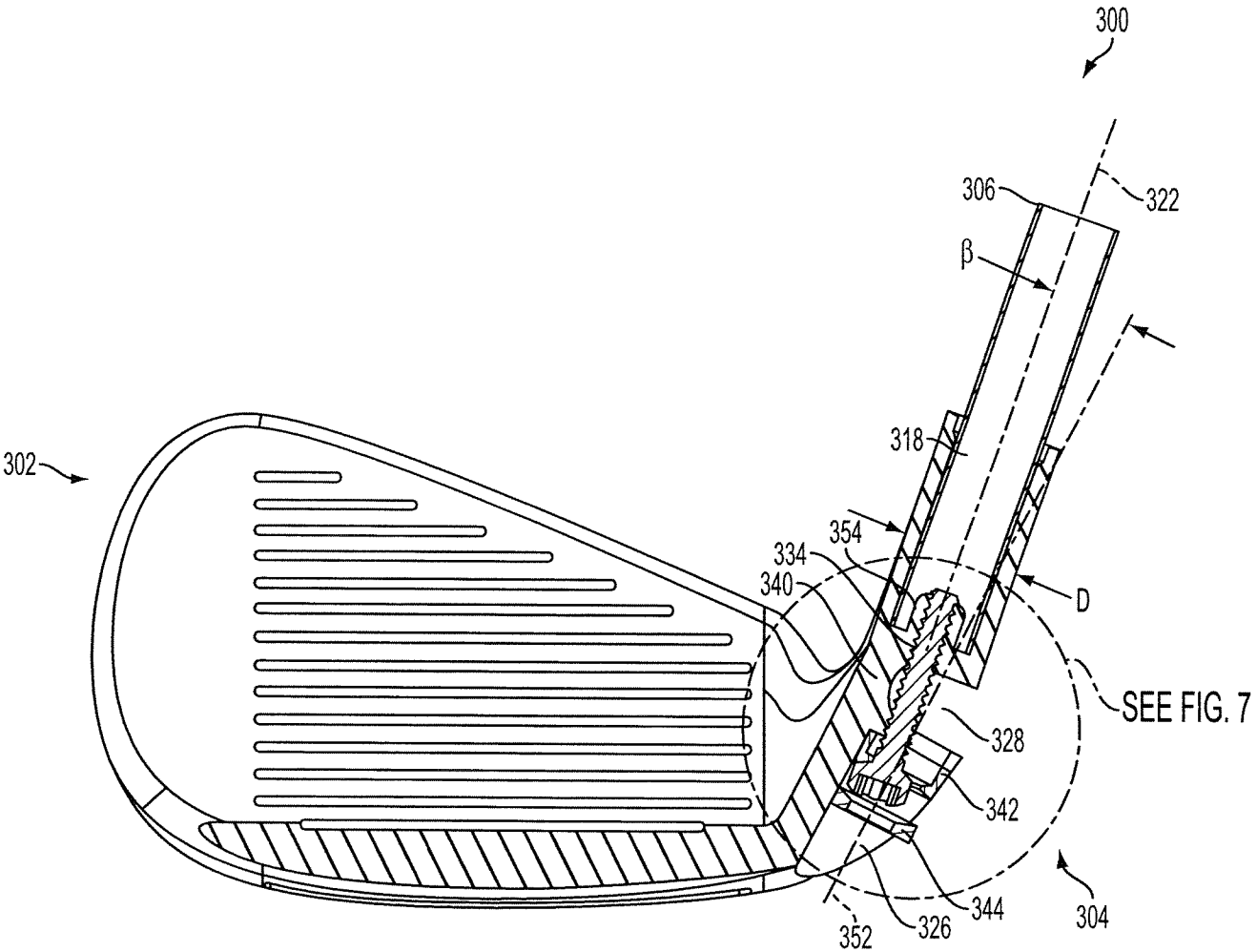
FIG. 6 shows a cross sectional view of another alternative exemplary embodiment of an adjustable golf club.
Figure 7:
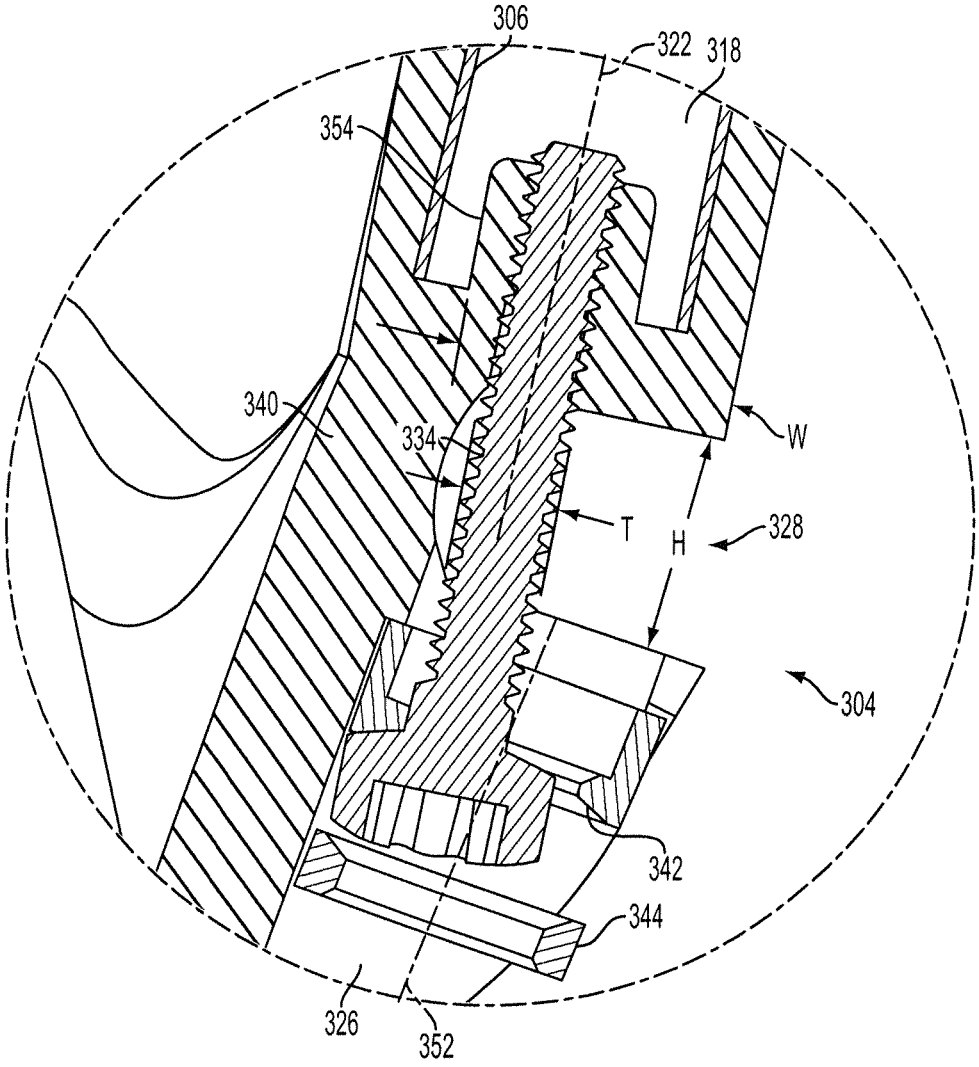
FIG. 7 shows an enlarged detailed partial cross sectional view of the adjustable golf club of FIG. 6.

FIGS. 6 and 7 show golf club head 300 as an alternative embodiment which includes a body 302 and a hosel 304. The hosel 304 has a shaft bore 318 having a central longitudinal axis 322 and which can accommodate a golf club shaft 306. The club head 300 also includes an adjustment bore 326 having a central longitudinal axis 352, which can accommodate a bearing pad 342 and a retaining ring 344. The club head 300 also includes a boss element 354 located at a distal end of the shaft bore 318 which can provide additional threads for engaging a threaded portion of an adjustment screw 334. The boss element 354 can be formed integrally with the rest of the hosel 304. For example, the boss element 354 can be formed as the hosel 304 is cast, or the boss element 354 can be machine cut from the hosel 304 after the hosel 304 is cast.

The golf club head 300 can be bent about a living hinge 340 by tightening or loosening the screw 334 in a manner similar to that described with respect to golf club head 200. Changes in angle β (FIG. 6), measuring the angular displacement between the longitudinal axis 322 of the shaft bore 318 and the longitudinal axis 352 of the adjustment bore 326, can indicate the degree to which the lie angle of the club head 300 has been adjusted. For example, a golf club can be fabricated, sold, and/or delivered with the golf club head 300 in a neutral configuration wherein the angle β is zero. In such a configuration, the angle β indicates the degree the lie angle has been adjusted from the neutral configuration.

FIGS. 6-7 illustrate that the hose 304 can have a diameter D and can include a notch 328 having a height H and a width W. The screw 334 can be of a standardized size, and can be, for example, between a size M3 and a size M8 screw. The screw 334 can have a maximum thread diameter T of between about 3 and 8 mm. In some embodiments, the diameter D can be between about 12.3 mm and about 14.0 mm, or more specifically, between about 12.5 mm and 13.6 mm. The height H can be between about 0.9 and 20.0 mm, and the width W can be greater than half the hosel diameter D. In some embodiments, the width W can be greater than half the sum of the thread diameter T and the hosel diameter D. In some embodiments, the width W can be greater than the sum of the thread diameter T and half the hosel diameter D. Thus, the width W can be governed in different embodiments by the following equations:

$$W>0.5*D$$

$$W>0.5*(D+T)$$

$$W>T+(0.5*D)$$

The greater the distance W is, the less material is present in the living hinge 340, and thus less force is required to adjust the golf club head 300. In addition, the greater the distance W is, the longer the moment arm is between the screw 334 and the hinge 340, and thus less force is required to adjust the golf club head 300.

Figure 10:
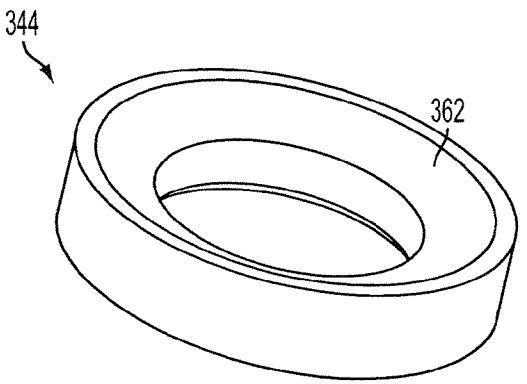
FIG. 10 shows one view of an exemplary retaining ring which can be used with adjustable golf club heads disclosed herein.
Figure 11:
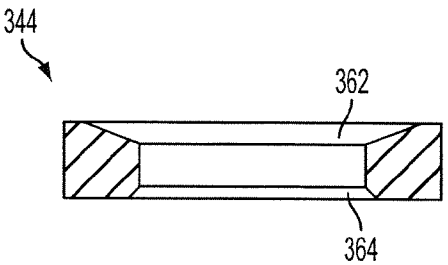
FIG. 11 shows a cross sectional view of the retaining ring of FIG. 10.
Figure 8:
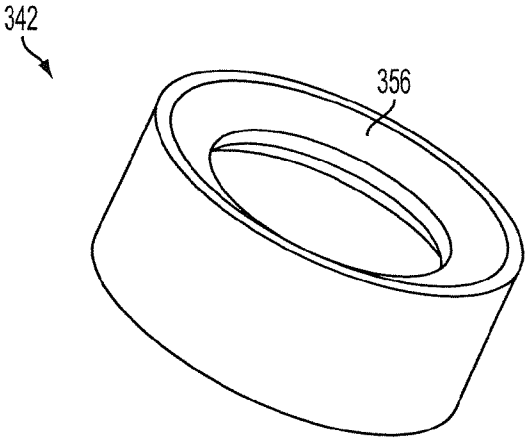
FIG. 8 shows one view of an exemplary bearing pad which can be used with adjustable golf club heads disclosed herein.
Figure 9:
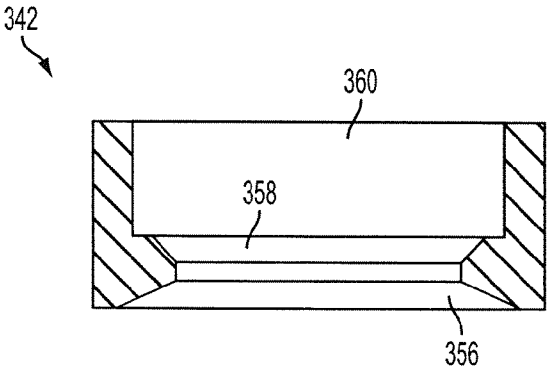
FIG. 9 shows a cross sectional view of the bearing pad of FIG. 8.

FIGS. 8 and 9 illustrate the bearing pad 342 in greater detail. As shown, the bearing pad 342 can include a spherical bearing or mating surface 356 for mating with the head of the screw 334. The bearing pad 342 can also include a chamfered edge 358 and a relief area 360. FIGS. 10 and 11 illustrate the retaining ring 344 in greater detail. As shown, the retaining ring 344 can include a spherical bearing or mating surface 362 for mating with the head of the screw 334 and a chamfered edge 364. The surfaces of the head of the screw that mate with the bearing pad and the retaining ring can have various shapes, for example, these surfaces can be generally spherically shaped.

Spherical surfaces such as bearing surfaces 356 and 362 are especially advantageous because they can help to ensure proper loading of the bearing pad 342 and retaining ring 344 as the club head 300 bends about hinge 340. That is, regardless of the degree to which bending at the hinge 340 causes the head of the screw 334 to move with respect to the bearing pad 342 or retaining ring 344, the head of the screw 334 will always have a complementary mating surface for bearing against either the bearing pad 342 or the retaining ring 344. For example, bearing pad 342 and retaining ring 344 can be desirable for use with embodiments of adjustable golf club heads in which both the lie angle and the loft angle are intended to be adjustable.

Figure 12:
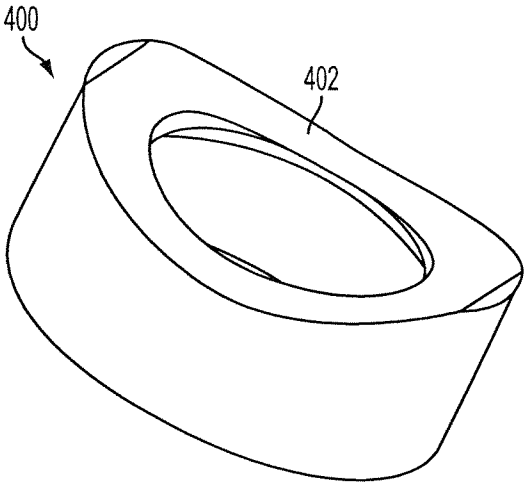
FIG. 12 shows one view of another exemplary bearing pad which can be used with adjustable golf club heads disclosed herein.
Figure 13:
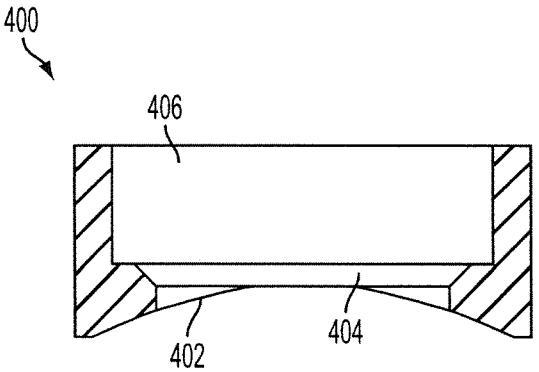
FIG. 13 shows a cross sectional view of the bearing pad of FIG. 12.
Figure 14:
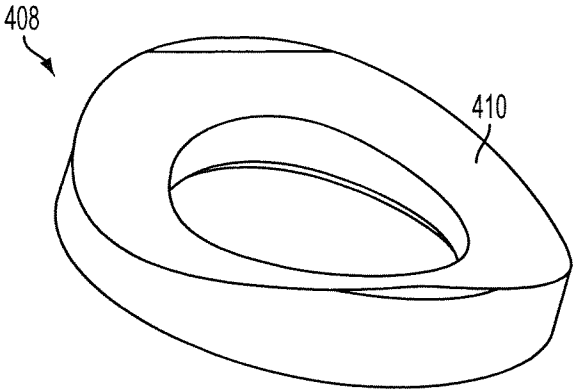
FIG. 14 shows one view of another exemplary retaining ring which can be used with adjustable golf club heads disclosed herein.
Figure 15:
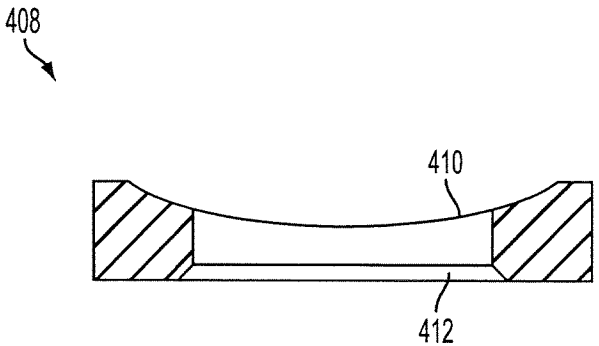
FIG. 15 shows a cross sectional view of the retaining ring of FIG. 14.

FIGS. 12 and 13 illustrate an alternative bearing pad 400 which can be used with golf club head 300 in place of bearing pad 342. As shown, the alternative bearing pad 400 can include a cylindrical bearing or mating surface 402 for mating with the head of the screw 334. The bearing pad 400 can also include a chamfered edge 404 and a relief area 406. FIGS. 14 and 15 illustrate an alternative retaining ring 408 which can be used with golf club head 300 in place of retaining ring 344. As shown, the retaining ring 408 can include a cylindrical bearing or mating surface 410 and a chamfered edge 412.

Cylindrical surfaces such as bearing surfaces 402 and 410 are advantageous in cases where movement of the head of the screw 334 is confined to a single dimension. In such cases, the dimension along which the head of the screw 334 is anticipated to move can be aligned with the cylindrical shape of the surfaces 402 and 410. In such a configuration, the head of the screw 334 will always have a complementary mating surface for bearing against either the bearing pad 400 or the retaining ring 408. For example, bearing pad 400 and retaining ring 408 can be desirable for use with embodiments of adjustable golf club heads in which only the lie angle is intended to be adjustable, with the cylindrical shape of surfaces 402 and 410 being aligned with an axis extending through the notch, screw, and hinge of the adjustable golf club head.

In some embodiments, the bearing pad and/or the retaining ring of a golf club head can be provided with a conical, rather than cylindrical or spherical bearing or mating surface for mating with the head of an adjustment screw. Such a surface can provide a different profile for contacting the head of the screw than spherical or cylindrical surfaces can provide.

In one alternative embodiment, a golf club head can have a threaded first opening connecting the adjustment bore to the notch, and an unthreaded second opening connecting the shaft bore to the notch. In such an embodiment, the head of the screw can be positioned within the adjustment bore, and the screw can thread through the first opening, extend across the notch and through the second opening, and terminate at a relatively wide or expanded tip situated within the shaft bore. The shaft bore can have a retaining ring situated therein, thus trapping the expanded tip of the screw at the distal end portion of the shaft bore. Thus, in a manner similar to that described above, by turning the screw in the threads of the first opening, the tip of the screw can be caused to either pull on the distal end of the shaft bore or push against the retaining ring situated within the shaft bore, thereby causing adjustments in the geometry of the golf club head. In one specific implementation, a set screw can be used in this alternative embodiment, in which case the head of the screw can be flush with its shaft.

In some embodiments, a filler element or cap can be inserted into the notch, in order to fill or enclose the space therein. In some cases, the filler element can be non-functional. In some cases, the filler element can improve the aesthetic properties of the adjustable golf club head by providing a flush surface or in other ways. In some cases, the filler element can provide additional rigidity and/or strength to the golf club head. Filler elements can be compliant, one-size fits all components which can be used with a golf club head as it is adjusted, or can come in a set of varying sizes such that as the golf club head is adjusted, different filler elements can be used to cover the notch based on the degree to which the club head has been adjusted. Filler elements are desirably configured to not interfere with the adjustability of the golf club head, and in some cases can be easily removable and replaceable.

In some embodiments, a golf club head can include adjustment range limiters which can limit the range of angles through which the lie or loft angles of the club head can be adjusted. An adjustment range limiter can prevent the living hinge being bent beyond a predetermined range and can thus help to prevent damage to and reduce fatigue in the hinge. As one example, a solid piece of material secured within the shaft bore can help to prevent an adjustment screw being tightened beyond a predetermined level. As another example, an adjustment screw can be configured so that it is impossible to loosen it beyond a predetermined level, for example, because it will run out of the threads in the opening between the notch and the shaft bore. In one specific embodiment, a golf club head can be fabricated in a neutral configuration and can be configured such that its lie angle is adjustable through a range of 5° in either direction, i.e., through a total range of 10°.

In some embodiments, a golf club head can include visual indicators which can indicate to a golfer the level to which the screw is tightened and thus the level to which the lie angle of the club head has been adjusted. For example, tabs, notches, or other indicators can be provided on each of the screw head and the hosel, the relative positions of which can indicate each degree, or each half degree, or each quarter degree of adjustment of the lie angle of the golf club head. In some cases, tabs, notches, or other indicators can be provided on the screw head, which can indicate how far the screw head has been turned. In some cases, notches or other indicators can be provided on the shaft of the screw in order to indicate the distance the shaft of the screw has traveled relative to other components of the golf club head.

The screws described herein can be either right-handed or left-handed screws. That is, depending on the particular screw used, turning the head of the screw clockwise can either tighten or loosen the screw.

FIGS. 1-7 illustrate an adjustable golf club head having a living hinge. A living hinge can be advantageous as a hinging mechanism because it experiences minimal friction and wear, and because it is relatively simple and cost effective to manufacture. Notably, the living hinge addresses current brute force methods using substantial force to plastically deform structurally strong hosel designs. While the disclosed embodiments significantly weaken the hosel itself by removing material to form a living hinge, the adjustment mechanism (which may be a screw in some embodiments) reinforces the structural integrity and strength of the hosel. In alternative embodiments, the principles, methods, and mechanisms described with regard to the living hinge of FIGS. 1-7 can be applied to other mechanisms for allowing a golf club head to be bent, including, for example, a rack and pinion system, a cam system, or any other mechanical hinging mechanism.

Adjustable golf club heads as described herein can be adjusted to improve a golfer's performance. For example, one method of adjusting a golf club head includes determining that a player's swing may benefit from an adjustment of the lie angle of one or more of their golf clubs, determining the amount of adjustment of the lie angle for the golf club to be adjusted, adjusting the golf club by turning a screw to cause the hosel to move toward or away from the club face, and ending the adjustment once the desired lie angle is obtained. In some cases, the adjustment can be ended when a visual indicator reveals that the desired lie angle has been achieved.

Various components of the golf club heads described herein can be formed from any of various appropriate materials. For example, components described herein can be formed from steel, titanium, or aluminum. Significant frictional forces can be developed between the surfaces of various components described herein as a golf club head is adjusted. Thus it can be advantageous if various components are fabricated from brass or other relatively lubricious materials, or if any of various surfaces are treated with any of various lubricants, including any of various wet or dry lubricants, with molybdenum disulfide being one exemplary lubricant. Frictional forces can help to ensure that the screw is not unintentionally tightened, loosened, or removed from the openings and the adjustment bore. Thus, various means can be used to advantageously increase frictional forces between various components. For example, chemical compounds or other thread locking components can be used for this purpose.

FIGS. 1-7 show adjustable iron-type golf club heads. In alternative embodiments, however, the features and methods described herein can also be used with a metalwood-type golf club head, or any type of golf club head generally. FIGS. 1-7 show a golf club head intended for use by a right-handed golfer. In alternative embodiments, however, any of the features and methods disclosed herein can also be used with a golf club head intended for use by a left handed golfer.

The components of the golf club heads described herein can be fabricated in any of various ways, as are known in the art of fabricating golf club heads. Features and advantages of any embodiment described herein can be combined with the features and advantages of any other embodiment described herein except where such combination is structurally impossible.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An adjustable golf club head comprising:

a main body;

a screw having threads; and a hosel having a shaft bore for receiving a golf club shaft, an adjustment bore for receiving the screw, a notch, an unthreaded opening connecting the notch to the adjustment bore, and a threaded opening connecting the notch to the shaft bore, wherein:

the threaded opening has threads complementing the threads of the screw; and the screw extends from the adjustment bore, through the first opening, through the notch, through the second opening, and into the shaft bore.

2. The golf club head of claim 1, wherein:

the shaft bore has a central longitudinal axis;

the adjustment bore has a central longitudinal axis; and adjustment of the screw causes the central longitudinal axis of the shaft bore to rotate with respect to the central longitudinal axis of the adjustment bore.

3. The golf club head of claim 1, further comprising a solid piece of material situated within the shaft bore which separates a portion of the shaft bore which can receive the screw and a portion of the shaft bore which can receive a golf club shaft.

4. The golf club head of claim 1, further comprising a threaded boss element coupled to the hosel at a distal end portion of the shaft bore.

5. The golf club head of claim 1, wherein a range limiter coupled to the hosel mechanically limits tightening of the screw.

6. The golf club head of claim 1, further comprising indicators which indicate a level to which the screw is tightened.

7. The golf club head of claim 1, wherein the notch extends past a centerline of the hosel.

8. The golf club head of claim 1, further comprising a bearing pad situated between the head of the screw and the opening.

9. The golf club head of claim 8, wherein the bearing pad comprises a spherical surface which can mate with the head of the screw.

10. The golf club head of claim 8, wherein the bearing pad comprises a cylindrical surface which can mate with the head of the screw.

11. The golf club head of claim 8, further comprising a retaining ring situated within the adjustment bore.

12. The golf club head of claim 11, wherein the retaining ring comprises a spherical surface which can mate with the head of the screw.

13. The golf club head of claim 11, wherein the retaining ring comprises a cylindrical surface which can mate with the head of the screw.

* * * * *